US006976662B2

(12) United States Patent
Kump et al.

(10) Patent No.: US 6,976,662 B2
(45) Date of Patent: Dec. 20, 2005

(54) CEILING GRID SIGN HANGER

(75) Inventors: Daniel J. Kump, Gates Mills, OH (US); Stephen D. Wamsley, Lakewood, OH (US); Joseph P. Kosir, Euclid, OH (US)

(73) Assignee: Fasteners for Retail, Inc., Cleveland, OH (US)

( * ) Notice: Subject to any disclaimer, the term of this patent is extended or adjusted under 35 U.S.C. 154(b) by 98 days.

(21) Appl. No.: 10/083,251

(22) Filed: Oct. 22, 2001

(65) Prior Publication Data

US 2002/0148938 A1 Oct. 17, 2002

Related U.S. Application Data

(63) Continuation-in-part of application No. 09/516,551, filed on Mar. 1, 2000, now abandoned.

(51) Int. Cl.[7] ..... A47H 1/10

(52) U.S. Cl. ..... 248/317; 248/222.52; 403/348; 403/397; 52/39

(58) Field of Search ..... 248/317, 340, 248/342, 343, 222.52, 228.1, 72; 403/397, 403/350, 348; 40/617; 52/39, 714

(56) References Cited

U.S. PATENT DOCUMENTS

| | | | | |
|---|---|---|---|---|
| 1,662,539 A | * | 3/1928 | Schmidt | 104/111 |
| 2,590,030 A | * | 3/1952 | Obert | 38/104 |
| 2,942,314 A | * | 6/1960 | Debner et al. | 403/391 |
| 3,003,735 A | | 10/1961 | Havener | |
| 3,018,080 A | | 1/1962 | Loudon | |
| 3,100,319 A | | 8/1963 | Carlson | |
| 3,371,900 A | * | 3/1968 | Jacobs | 248/343 |
| 3,575,371 A | * | 4/1971 | Carlstedt | 248/215 |
| 3,589,660 A | | 6/1971 | Dunckel | |
| 3,743,228 A | | 7/1973 | Drab | |
| 3,952,985 A | | 4/1976 | Davenport | |
| 4,025,019 A | | 5/1977 | Jacobsen et al. | |
| 4,065,090 A | | 12/1977 | Mauney | |
| 4,073,458 A | | 2/1978 | Sease | |
| 4,112,550 A | | 9/1978 | DeWitt et al. | |
| 4,118,000 A | | 10/1978 | Campbell | |
| 4,135,692 A | | 1/1979 | Ferguson | |
| 4,163,576 A | | 8/1979 | Hoop | |
| 4,191,352 A | | 3/1980 | Schuplin | |
| 4,291,855 A | * | 9/1981 | Schenkel et al. | 248/74.1 |
| 4,315,611 A | | 2/1982 | Hoop | |
| 4,323,215 A | | 4/1982 | Berger | |

(Continued)

OTHER PUBLICATIONS

FFR 1999 Yellow Pages Catalogue, Cover Page and pp. 76-80.

*Primary Examiner*—Korie Chan
(74) *Attorney, Agent, or Firm*—Fay, Sharpe, Fagan, Minnich & McKee, LLP

(57) ABSTRACT

The invention relates to a sign hanger A, for facilitating the hanging of items such as a banner or the like from suspended ceiling grids in a store. The sign hanger is adapted to have a twist-lock releasable connection with a ceiling grid. A friction lock structure 42, 58 is added to decrease the likelihood of accidental deinstallation of the sign hanger A. In one embodiment the hanger has an elongated body 10 having spaced apart flanges 125, 130 in order to hold a banner 200. In another embodiment the hanger has a centrally located plateau 864, which co-operates with tapered surfaces 836 and 850 on respective clips 804 and 808 to hold the hanger in place on the ceiling grid.

18 Claims, 9 Drawing Sheets

U.S. PATENT DOCUMENTS 4,422,609 A 12/1983 Clark
4,564,165 A 1/1986 Grant et al.
4,667,913 A 5/1987 Peelle et al.
5,024,405 A * 6/1991 McGuire ..... 248/73
5,230,488 A * 7/1993 Condon ..... 248/73
5,490,651 A 2/1996 Kump

* cited by examiner

C
474
494
484
462
444
446
408
450
460
470
424
404
490
480
428

412
454
420
461
436

416
440
432

D
862
820
808
844
824
804
828
874
863
876
878
875

804
824
812
864
861
840
854
808
820

861
816
820
804
864
808
824
884
874
878
880
876
890
870
894
875

828
859
804
832
836
850
846
808
864
844
858
856
862

856
859
899
860

CEILING GRID SIGN HANGER

BACKGROUND OF THE INVENTION

1. Field of the Invention

This is a continuation-in-part of application Ser. No. 09/516,551, filed Mar. 1, 2000, now abandoned. The invention relates primarily to sign displays in stores. More particularly, the present invention concerns releasable twist lock fasteners for securing displays to a suspended ceiling.

2. Description of Related Art

Clip assemblies for hanging objects from suspended ceiling grid work are known in the art. U.S. Pat. No. 4,323,215 to Berger, discloses one known hang-up fixture. The fixture includes a flat seating surface with spaced apart upward projections each having a laterally directed fin. When installed, the fins and the flat seating surface act as clips and hold onto a horizontal flange of an inverted T type grid work member. The fixture can be installed by using an extension pole with an installation tool mounted on its distal end. In at least some installations, the amount of friction applied between the clips of the fixture and the grid work member is insufficient. Small torques, inadvertently applied by installers, or even by a breeze acting on a sign being carried by the fixture, can be enough to dislodge the fixture and send the sign crashing to the ground.

U.S. Pat. No. 4,191,352 to Schuplin discloses a known rotatably installed suspension clip that addresses the insufficient friction issue. The disclosed clip is made of sheet metal. Bent arm portions of this clip are similar to the fins of the Berger fixture. A section of the bent arm portions is partially severed, bent downward and formed into a pointed barb. Any inadvertently applied dislodging torque, forces the barb to bite into the grid work flange and bind, thus preventing the suspension clip from being easily dislodged. In order to intentionally remove the clip, the barbs must be individually pried and bent upward with a screwdriver or the like. This is a slow, time consuming task, and often requires maintenance personnel to work from inconvenient and precarious ladders. Additionally, the barbs can scratch and mar the paint or protective coating of the grid work. In this regard the suspension clip of Schluplin is not releasable. As used here releasable means easily removable, without the used of tools such as screw drivers or pliers for prying parts of the sign hanger out of engagement with the associated ceiling grid or other hanger support. (obviously, reach extending tools operative to facilitate the installation or deinstallation such as those described below are not for prying parts of the sign hanger out of engagement with the associated ceiling grid hanger.)

In addition to the problems outlined above, both of the known clips previously mentioned are also limited in the size and weight of the object that can be carried.

U.S. Pat. No. 4,564,165 to Grant et al. shows a two-piece attaching device that most likely requires the use of a ladder to install. Its use is limited to hanging signs that can have their upper edge bent into an inverted V-shaped lip. The lip is then used to beneficially apply the weight of the sign to portions of the attaching device in such a way as to press shoulders of one part of the device into pockets of another part of the device. An attempt to hang some other sort of item from the attaching device, such as, for example, a plant, would likely result in unbalanced forces being applied to portions of the attaching device, resulting in the shoulders becoming disengaged from the pockets and the plant and at least one part of the attaching device falling to the floor.

Conventional clips or hangers have a number of disadvantages. Some of them can become disengaged too easily. Others bind and bite into the flange they are installed on, are difficult to remove, and are not releasable as the term is used here. Still others are comprised of multiple components and are adapted for use with only one type of object. Also, none of the prior art designs can support wide banners from a single one-piece clip.

Accordingly, it has been considered desirable to develop a new and improved ceiling grid sign hanger construction, which would overcome the foregoing difficulties and others while providing better and more advantageous overall results.

BRIEF SUMMARY OF THE INVENTION

One aspect of the invention is an object hanger that provides for objects such as signs and plants to be quickly hung and removed from the grid work of a suspended ceiling.

In some embodiments the inventions takes the form of a ceiling grid object hanger including a support body having a first portion, a longitudinal axis and a pivot axis. The support body lies within a support body plane. A first arm extends away from the first portion. A second arm extends away from the first portion. The first arm is located on a first side of the longitudinal axis and the second arm is located on a second side of the longitudinal axis. A first protrusion extends from the first arm toward the first portion. A second protrusion extends from the second arm toward the first portion. The first and second protrusions engage an associated ceiling grid to releasably resist disengagement of said object hanger from the associated ceiling grid. A first planar object support flange depends from the first portion and lies substantially in an object support plane. The object support plane is approximately perpendicular to the support body plane and intersecta the pivot axis. A first attachment means is located on the object support flange for supporting an object.

In some embodiments the invention is a ceiling grid banner hanger including an elongated support body having a top side, an opposed bottom side and a longitudinal axis. A first arm extends away from the top side. A second arm also extends away from the top side. The first arm is located on a first side of the longitudinal axis and the second arm is located on a second side of said longitudinal axis. A first object support flange extends away from the bottom side and a second object support flange extends away from the bottom side, in spaced relation from said first object support flange. The first and second object support flanges lie substantially in a single object support plane.

In some embodiments the invention includes a ceiling grid banner hanger operative to suspend a sign from an associated ceiling grid. The hanger includes a support body having a top side, an opposed bottom side and a longitudinal axis. A first arm extends away from the top side, and a first protrusion extends from the first arm toward the top side. A second arm extends away from the top side, and a second protrusion extends from the second arm toward the top side. A third protrusion extends upwardly from the top side. The first, second and third protrusions engage planar surfaces of an associated ceiling grid to resist disengagement of the support body from the associated ceiling grid. The first, second and third protrusions comprise a material, which does not gouge the associated ceiling grid to which the support body is selectively secured. A first object support flange extends away from the support body bottom side.

In some embodiments the invention is a one-piece ceiling grid object hanger. The one-piece ceiling grid object hanger includes a support body defining a support body plane and has a longitudinal axis and a rotational axis. A first arm extends away from the support body. A second arm also extends away from the support body. The first arm is located on a first side of the longitudinal axis and the second arm is located on a second side of the longitudinal axis. A first tapered portion or surface depends from the first arm, the first tapered portion or surface tapers towards the longitudinal axis. A second tapered portion or surface depends from the second arm. The second tapered portion or surface tapers towards the longitudinal axis. The first and second tapered portions and the support body co-operate to engage an associated ceiling grid member with a progressively firmer grip as the object hanger is rotated from a disengaged position relative the ceiling grid into an engaged position. A first planar object support flange depends from the support body. The first planar object support lies substantially in a first object support plane. The object support plane is perpendicular to the support body plane and intersects a rotational axis of the support body. A first attachment means associated with the first planar object support flange is operative to support an object.

BRIEF DESCRIPTION OF THE DRAWINGS

The invention may take form in various components and arrangements of components, and in various procedures and arrangements of procedures. The drawings are only for purposes of illustrating preferred embodiments, they are not to scale, and are not to be construed as limiting the invention.

DETAILED DESCRIPTION OF THE PREFFERED EMBODIMENTS

Referring now to the FIGURES, wherein the drawings are for purposes of illustrating the preferred embodiments of the invention and not for limiting the same, FIGS. 1A–1C, 5A–5C, 6A–6C and 8A–8D show first, second, third and fourth sign hangers A, B, C and D respectively, each hanger in accord, respectively, with a first, second, third and fourth preferred embodiments of the present invention. While the hangers are disclosed as being adapted for use to secure a banner, sign, plant or the like, to an overhead member such as a ceiling grid structure, it should be appreciated that the hanger construction can be utilized for a variety of other purposes as well, such as securing and object, fastened to the hanger, to another member. In this connection, it should be recognized that the member to which the hanger is fastened does not need to be an overhead member, such as a ceiling grid. Rather the hangers can be secured to objects located at the base, or walls of a structure, or attached to a section of a vehicle or the like.

Figure 1A:
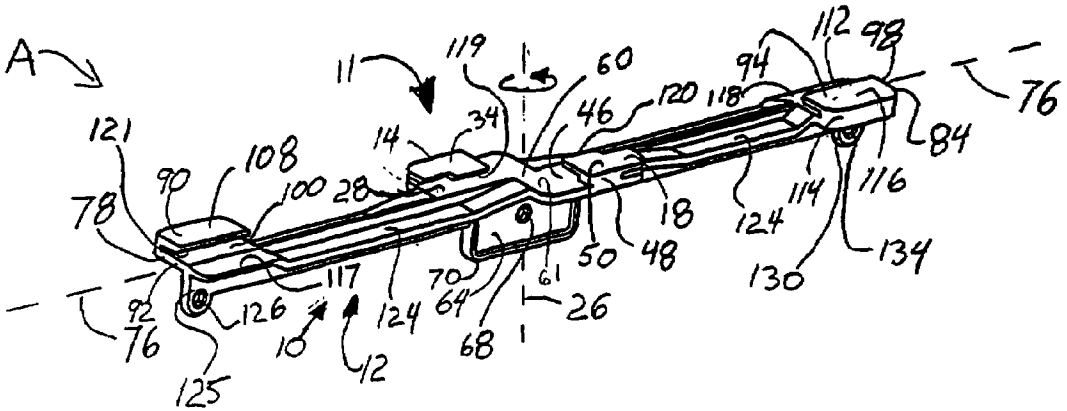
FIG. 1A is a perspective view of a first sign hanger in accordance with a first preferred embodiment of the present invention.
Figure 1B:
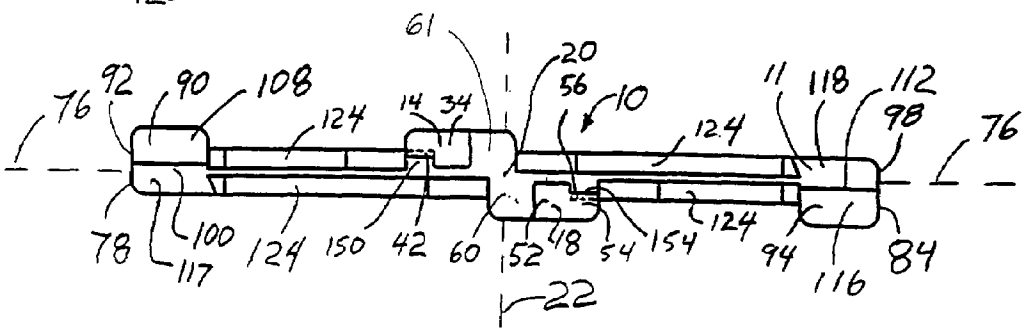
FIG. 1B is a top plan view of the sign hanger of FIG. 1A.
Figure 1C:
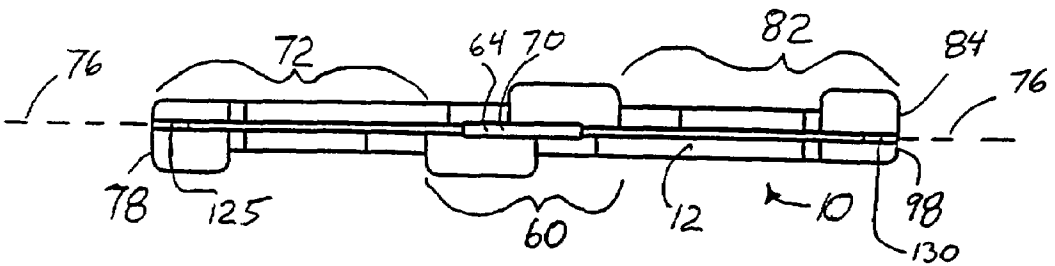
FIG. 1C is a bottom plan view of the sign hanger of FIG. 1A.

With reference now to FIGS. 1A–1C, a first sign hanger or support A has an elongated body 10. The elongated body 10 has a first portion having first face or top side 11 and a second face or bottom side 12. First and second clips 14, 18 extend upward from the top side 11. The first and second clips 14, 18 are opposedly disposed and laterally separated from a centrally located pivot point 20 and a central transverse axis 22 that runs perpendicularly through an axis of rotation or pivot axis 26 of the body. As will be seen in greater detail in reference to FIGS. 4A and 4B, the first sign hanger is rotated about the axis of rotation or pivot axis 26 during the installation process.

Figure 2A:
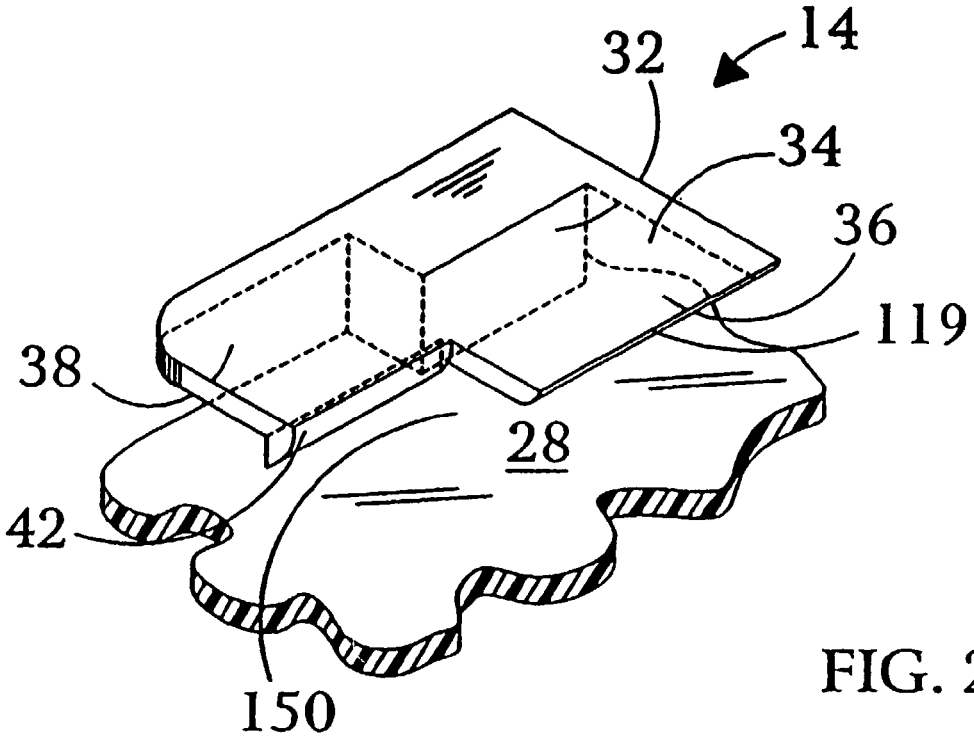
FIG. 2A is a greatly enlarged perspective view of a portion of the sign hanger of FIG. 1A, showing the details of a centrally located clip.

Referring briefly to FIG. 2A, the first clip 14 includes a first base or surface 28, from which a first arm extends. The first arm includes a stem 32 extending upward from the first surface 28, and a flange 34 supported in a cantilevered manner from the stem 32. The flange 34 includes a first region 36 and a second region 38. A non-binding friction-increasing protrusion, tapered surface or rib 42 projects toward the base surface 28 from the second region 38.

Referring again to FIGS. 1A–1C, the second clip 18 is a mirror image of the first clip 14. It includes a first or base surface 46, a stem 48, and a flange 50 including a first region 52, a second region 54, and a protrusion, tapered surface or rib 56.

The first sign hanger further includes a first support portion 60 on which the first and second clips 14, 18 are located. The support portion defines a contact surface 61, which extends across the width of the support portion from a first side edge of the support portion to a second side edge. The support portion is shaped as a stylized —Z—, as best seen in FIG. 1B. As is evident from FIG. 1A, the first surface 28 of the first clip 14 and the first surface 46 of the second clip 18 lie substantially in the same plane. In that regard the clips define a support body plane.

A first object support flange 64 extends downward from the second or bottom side 12 of the elongated body 10 at a location beneath the first support portion 60. The first object support flange 64 defines an object support plane. The first object support plane can be perpendicular to the support body plane. However, the mounting location of the first object support flange 64 is not critical. Some embodiments in accord with the present invention may not even include the first object support flange. Normally, however, the flange 64 is centrally located as depicted in the embodiment under illustration and described above. This allows a load (not shown) to be carried in a balanced fashion. Centrally locating the flange 64 also allows it to be used as a means for rotating the body 10 during an installation process. The installation process will be discussed in greater detail in relation to FIGS. 3, 4A and 4B.

In some prior art object hangers a support flange is punched and bent from the support body. This creates a void or hole in a contact surface of the prior art object hangers. Additionally, the act of punching and bending the support flange from the support body can bend and deform the contact surface. Creating the void in the support body reduces a contact surface area, thereby reducing a retention friction associated with the contact surface. The deformation can create bumps and dimples in the contact surface that cause the object hanger to be unstable during the installation process, thereby making installation difficult and inconvenient. For the forgoing reasons it is preferable that the contact surface 61, extend across the width of the support portion from a first side edge of the support portion to a second side edge. Such a contact surface does not contain voids and therefore maximizes a contact surface area and an associated retention friction. Additionally, such a contact surface is smooth and stable, thereby providing for easy and convenient installations.

The first object support flange 64 includes a means to attach an object to the first sign hanger A. In the illustrated embodiment, the means to attach an object is an eyelet or opening 68, useful for attaching a hook (not shown) or cord (not shown) or the like. Other attachment means are also contemplated. For example, an anchor or a hook can be included on the first object support flange. The eyelet or opening 68 shown is of a particular size, but other size attachment means are within the scope of the invention. For example, it is possible to include larger openings and, where necessary, a larger first object support flange. Care must be taken however, when contemplating reducing the size of the first object support flange 64. The first object support flange 64, including a perimeter rib 70, adds strength and rigidity to the central portion of the first sign hanger A. The required size and configuration of the first object support flange is a function of the weight the first sign hanger A is intended to carry. Additionally, it is preferable that the size and shape of the first object support flange allow it to fit securely within an installation tool. For example, the perimeter rib 70 is preferably sized to provide a snug fit within the installation tool, thereby preventing undue wobbling during an installation or deinstallation process. In this regard, the perimeter rib 70 is a widening rib in that the perimeter rib 70 provides the first object support flange 64 with extra width for strength and for proper tool mating, while allowing the first object support flange 64 to be manufactured with a minimum of material.

In one embodiment, the first sign hanger A is about one foot long and typical dimensions for the first object support flange 64 are, for example, about 1.875 inches×0.875 inches. A typical perimeter rib width is, for example, about 0.375 inches.

A second support portion 72 is connected to and extends away from the first support portion 60 in a first direction. The second support portion 72 extends along a longitudinal axis 76 of the first sign hanger A and extends a predetermined distance from the pivot point 20. The second support portion 72 terminates in a distal end 78. The longitudinal axis 76 runs parallel to a longitudinal axis of a ceiling grid horizontal flange 80 (see FIG. 4B) when the first sign hanger 10 is in an installed position. The longitudinal axis 76 is centered between the clips 14, 18 as best seen in FIG. 1B. The first object support flange 64 can lie along the longitudinal axis 76.

Similarly, a third support portion 82 is connected to the first support portion 60. The third support portion also extends along the longitudinal axis 76 of the first sign hanger A, the predetermined distance in a direction opposite that of the second support portion 72. The third support portion terminates in a distal end 84.

The first sign hanger A has been described as including the first, second, and third support portions (60, 72, and 82). However, since the preferred embodiment is manufactured as a single molded piece of conventional thermoplastic, the three support portions (60, 72, and 82) are embodied as sections of the single elongated body 10. It should be noted that conventional thermoplastic is softer that typical ceiling grid members. Therefore, sign hangers that include conventional thermoplastic will not gouge or mar the finish of ceiling grid members, even after repeated installations and removals. For the forgoing reasons, conventional thermoplastics are among the preferred materials for manufacturing the presently described sign hangers.

A third clip or arm 90 is supported at the distal end 78 of the second support portion and therefore at a first end 92 of the elongated body 10.

Similarly a fourth clip 94 is supported at the distal end 96 of the third support portion 82 and therefore at a second end 98 of the elongated body 10.

The first, second, third and fourth clips 14, 18, 90, and 94 all comprise arms that extend away from the first or top side 11 of the elongated body 10.

Figure 2B:
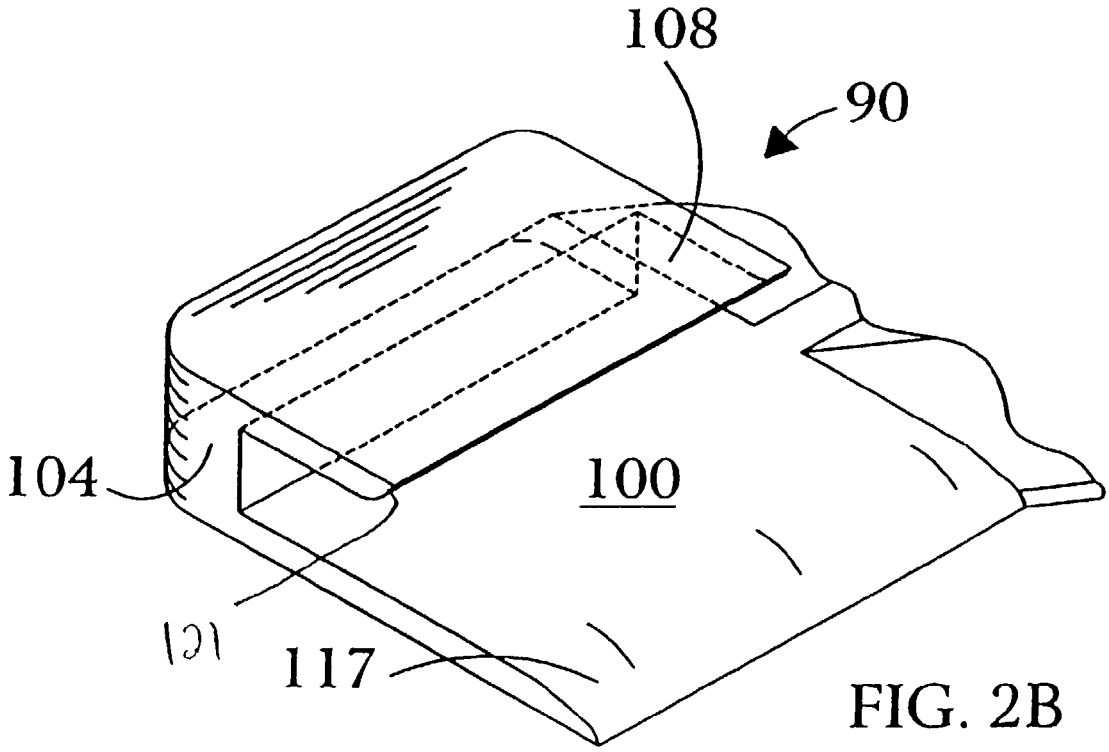
FIG. 2B is a greatly enlarged perspective view of another portion of the sign hanger of FIG. 1A, showing the details of a distally located clip.

Referring briefly to FIG. 2B, the third clip 90 includes a first or base surface 100, from which a third arm extends. The third arm includes a stem 104 extending upward from the first surface 100, and a flange 108 supported in a cantilevered manner from the stem 104. Referring now to FIGS. 1A and 1B, the fourth clip 94 is a mirror image of the third clip and also includes a first or base surface 112, a stem 114 extending upward from the first surface 112, and a flange 116 supported in a cantilevered manner from the stem 114.

The first surfaces 28, 46, 100, and 112 of each of the first, second, third and fourth clips 14, 18, 90, and 94 comprise four substantially flat co-planar regions supported by the elongated body 10 and lie in, or define, the support body plane. The first surfaces 100, 112 of the third and fourth clips 90 and 94 are located at opposite corners of the first sign hanger A and include downwardly sloping beveled portions 117, 118 that serve to guide the third and fourth clips 90 and 94 into alignment with the ceiling grid horizontal flange 80 (see FIG. 4A). Shorter beveled surfaces 119, 120, 121, 122 on the clip flanges 34, 50, 108, 116 of all of the clips 14, 18, 90, 94 also aid alignment to ease docking during installation.

With reference once again to FIGS. 1A–1C, as mentioned above, the first sign hanger A is made of a conventional thermoplastic. That thermoplastic is somewhat flexible. In order to provide increased rigidity to the first sign hanger A the second and third support portions 72 and 82 include stiffening ribs 124. The stiffening ribs 124 start adjacent to the first surfaces 28, 46 of the centrally located clips 14, 18, slope immediately below the first surface plane and extend along both sides of the elongated body 10. The stiffening ribs 124 then slope back upward just prior to terminating adjacent to the first surfaces 100, 112 of the distally located clips 90, 94. It is preferred that the stiffening ribs 124 run below the first surface plane of the clips 14, 18, 90, 94 in order to minimize friction as the first sign hanger A is rotated into an installed position of engagement with the ceiling grid horizontal flange 80 during the installation process (see FIGS. 4A and 4B).

A second object support flange 125 extends downward from the bottom or second side 12 of the elongated body 10, from a position adjacent to the distal end 78 of the second support portion 72. The second support member includes a means for attaching an object to the first sign hanger A. The means shown in this embodiment is an eyelet or opening 126 for securement of a cord (not shown) or a hook (not shown), but other attachment means can be used. For example, the second object support flange 125 can include an anchor or hook.

Similarly, a third object support flange 130 depends downward from the bottom or second side 12 of the elongated body 10, from a position adjacent to the distal end 96 of the third support portion 82. The third support member 130 includes a means for attaching an object to the first sign hanger A. The means for attaching an object shown in this embodiment is an eyelet or opening 134. The second and third support members can lie substantially in the object support plane.

The first surface 28, 46 of each clip 14, 18 is substantially flat. The first support portion 60 of the elongated body 10 holds the first surfaces 28, 46 of each clip 14, 18 in a co-planar fashion (in the support body plane). Extending upward from each first surface 28, 46 is a stem 32, 48. Each stem 32, 48 extends a distance approximating the thickness of the horizontal flange 80 of a conventional inverted T-shaped ceiling grid member 140 (see FIG. 4A) that the clip is meant to engage. The stems 32, 48 are laterally displaced from each other. The distance they are laterally displaced depends on the width of the ceiling grid horizontal flange they will engage. A typical lateral displacement distance for the stems is, for example, about one inch. An example of a typical stem height is about 0.063 inches.

Except for the short docking bevels 119, 120 at the leading edge of the first regions 36, 52 of each centrally located clip 14, 18, the first regions 36, 52 are substantially flat. The first regions 36, 52 act as stabilizers and rest points during the installation process. The function of the first regions 36, 52 will be discussed in greater detail below, in reference to FIG. 4B.

The second regions 38, 54 of each centrally located clip 14, 18 each include the protrusions, tapered surfaces or ribs 42, 56. The ribs 42, 56 are preferably molded in place. As the ribs 42, 56 engage the flange 80 (see FIG. 4A) of the grid element 140, a lifting torque is applied to the flanges 34, 50 and they are bent slightly upward. The flanges 34, 50 are made of a stiff but resilient material, and so, act as springs under compression. The slight bending upward of the flanges 34, 50 increases the gripping force applied to a surface (as opposed to an edge) of the horizontal flange 80 of the grid element 140.

The flanges 34, 50 of the centrally located clips 14, 18 of the preferred first sign hanger embodiment, each have a notch 150, 154, or absence of material, near the ribs 42, 58. It is preferable to mold features, such as ribs 42, 58, near the edge of structures such as the central clip flanges 34, 50. If the notches are not provided, then the edge of the second portions 38, 54 of the central clips 14, 18, and, therefore, the ribs 42, 58, would be positioned such that the ribs would engage the horizontal flange undesirably early in the installation process. Therefore, it is preferable that the notches 150, 154 are provided.

As mentioned, one embodiment of the first sign hanger can be molded from a conventional thermoplastic, such as Acrylonitrile-Butadiene-Styrene (commonly known in the art as ABS). However, other conventional materials, such as, for example, nylon or spring steel, can be used to make the sign hanger and still remain within the scope of the invention. Furthermore, a friction-increasing device, such as, for example, a protrusion, tapered surface or rib can be located on other surfaces. For example, as will be discussed in greater detail in reference to FIG. 7 and FIGS. 8A–8E a protrusion, tapered surface or rib can be located on the first surface 28 of the clip 14, or on some other surface of the sign hanger that engages a portion of the horizontal grid work member. As mentioned above, preferably, the sign hanger, or at least the ceiling grid engaging portions of the sign hanger, such as, for example, the ribs, protrusions or tapered surfaces, comprise a material that will not gouge the ceiling grid (e.g. ABS or Nylon).

While the preferred embodiment is a one-piece molding, an assembly having, for example, discrete clips, can be made and still remain within the scope of the invention. In addition, other non-binding, friction-increasing devices can be used in place of or in addition to the protrusions, tapered surfaces or ribs. For example, rubber strips or pads 156 (see FIG. 7) can be applied to any surface that engages a surface (as opposed to, for example, an edge) of the ceiling grid horizontal flange 80 of the grid work member 140. The rubber strips or pads 156 can be beveled or tapered. Such an embodiment would remain within the scope of the invention.

Preferably, the pads 156 are protrusions, tapered surfaces or ribs of one piece with the sign hanger. For example, the protrusions are molded into the sign hanger in the same manner as the rest of the parts or portions of the sign hanger. The pads, tapered surfaces or protrusions 156 can extend upward from a base surface and/or depend downward from a clip flange or arm. When located on a base surface, the pads, tapered surfaces or protrusions can be located under a clip flange or somewhere else on the base surface. For example, as will be discussed in greater detail in reference to FIGS. 8A–8E, a pad, tapered surface, or plateau can be located on a base surface between two or more clips. The best location for a given hanger design is a function of the clip design and operational parameters, such as, for example, intended supported object weight, intended ceiling grid dimensions, and desired gripping force. In some applications pads are preferable because they can be replaced when they become worn. In other applications protrusions, ribs, or plateaus that are of one piece with the sign hanger are preferred. One-piece construction is desirable because it is simple, and inexpensive, requiring no labor for assembly. Additionally, in one-piece construction there are no loose pieces that can fall off due to adhesive age or loosened fasteners.

In the preferred embodiment of the first sign hanger A the distally located clips 90, 94 do not include friction-increasing devices such as ribs, protrusions or tapered surfaces. However, friction-increasing devices could be included on the distally located clips 90, 94 if additional friction were required or found to be beneficial.

Figure 3:
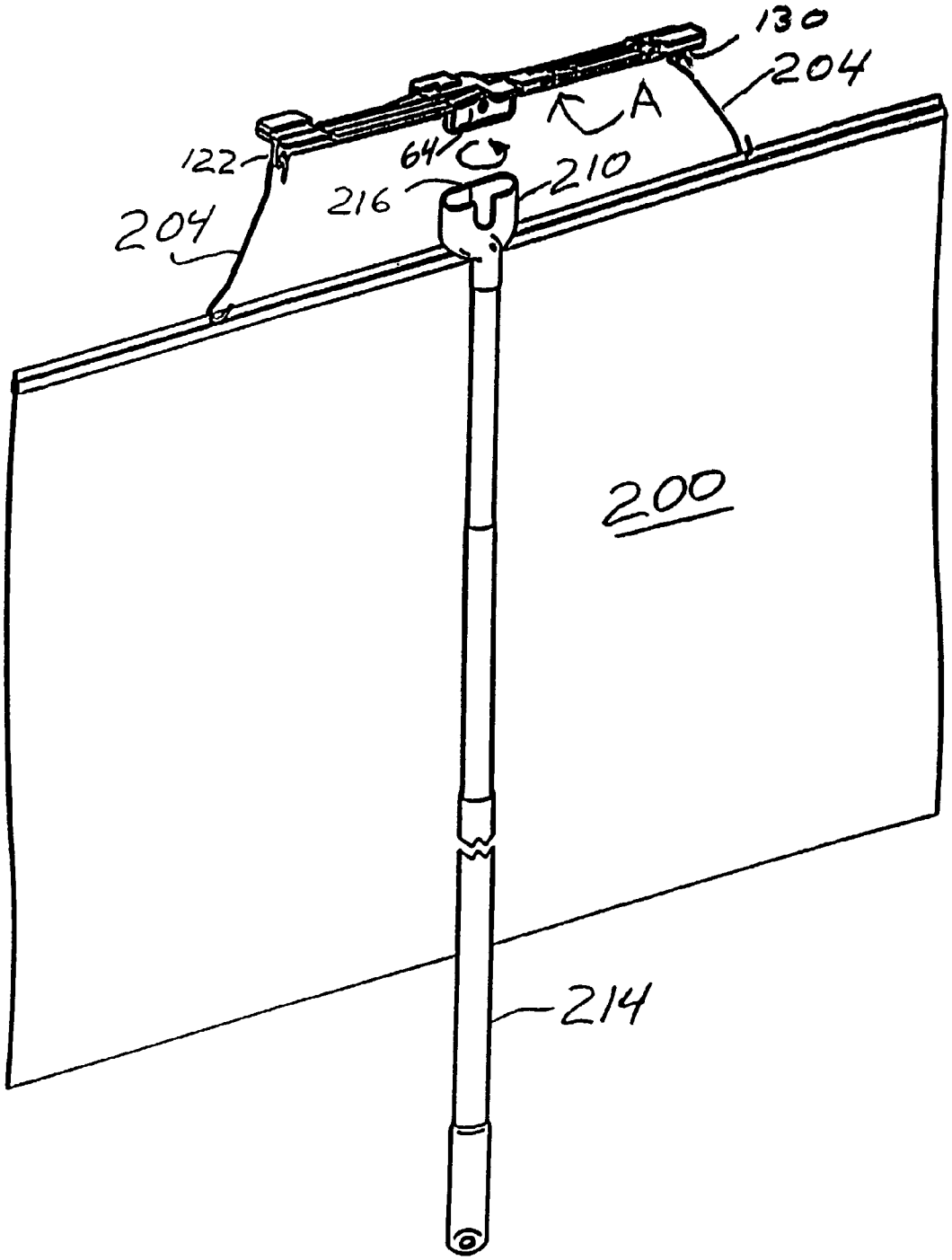
FIG. 3 is a schematic illustration showing the sign hanger of FIG. 1 as it is being installed, with an installation tool secured to the end of a telescopic pole, a banner that is shown as being supported by the sign hanger via hooks.

FIG. 3 illustrates the installation process. An installer (not shown) attaches an object, for example a sign or banner 200, to the first sign hanger A with some attachment means such as, for example, hooks 204 or cord (not shown). Since the sign or banner 200 illustrated is relatively wide, the sign or banner is hooked through eyelets in the second and third object support flanges 125, 130. A conventional installation tool 210 is shown at the end of a telescopic pole 214. The first object support flange 64 can be received in a socket 216 in the installation tool 210 and the first sign hanger A, together with the banner 200, can be lifted upward until the first sign hanger engages the horizontal flange 80 of the grid element 140. Then the installer can rotate the first sign hanger 10 into an installed position (see FIGS. 4A and 4B). The widening or perimeter rib 70 provides a snug fit for the first object support flange 64 within the socket 216 of the installation tool.

Figure 4A:
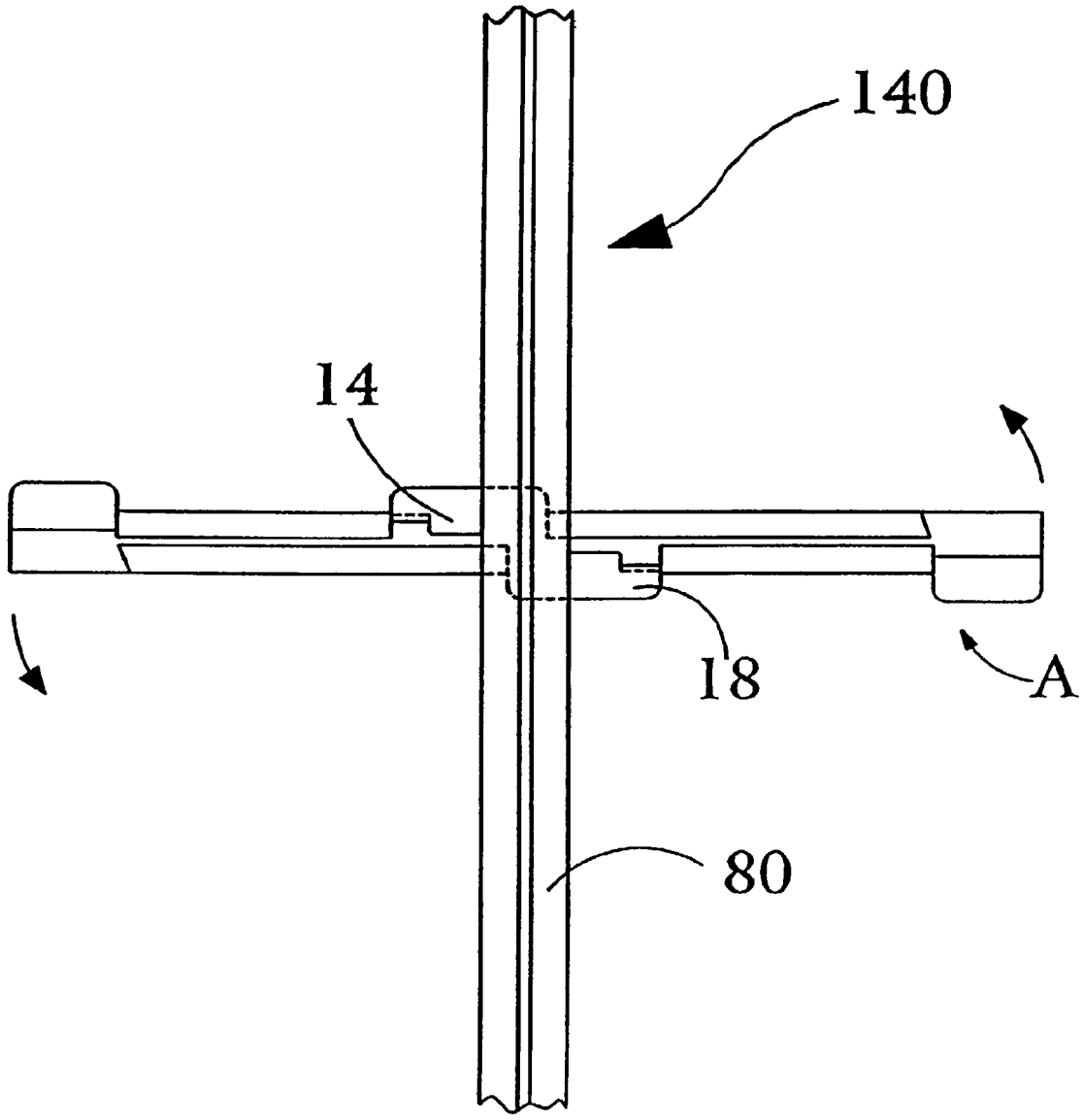
FIG. 4A is a first view in a sequence, showing a top view of the first sign hanger as it is being rotated into an installed position.
Figure 4B:
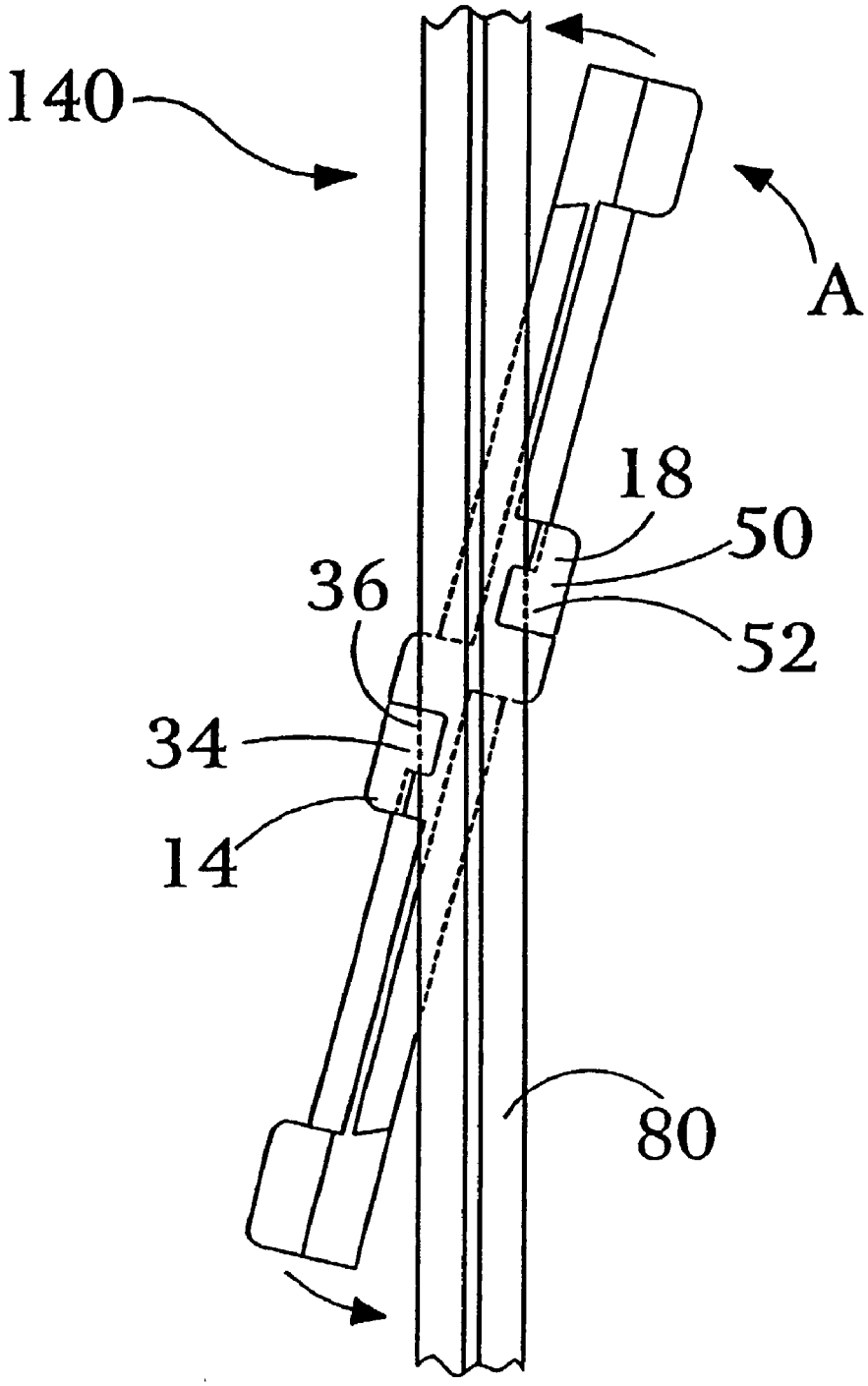
FIG. 4B is a second and final view in the sequence, showing a top view of the first sign hanger as it is being rotated into an installed position.

Referring now to FIG. 4A, the first sign hanger A is placed against the horizontal flange 80 in an unengaged position. In this position the sign hanger A is oriented normal to the longitudinal axis of the horizontal flange 80 of grid work element 140. It is clear that the clips 14, 18 just clear the width of the flange 80. FIG. 4B shows the first sign hanger A at an intermediate position as it is being rotated into engagement with the horizontal flange 80. The first regions 36, 52 of the flanges 34, 50 of the centrally located clips 14, 18 are partially engaging the upper surface of the horizontal flange 80. At this point in an installation process an installer can concentrate on twisting the first sign hanger further into the installed position and on overcoming the increased friction provided by the ribs 42, 58 of the second regions 38. In a completely installed position, all the clips, including the distally located clips 90, 94, engage a surface (as apposed to an edge) of the flange 80 of the grid element 140.

Figure 5A:
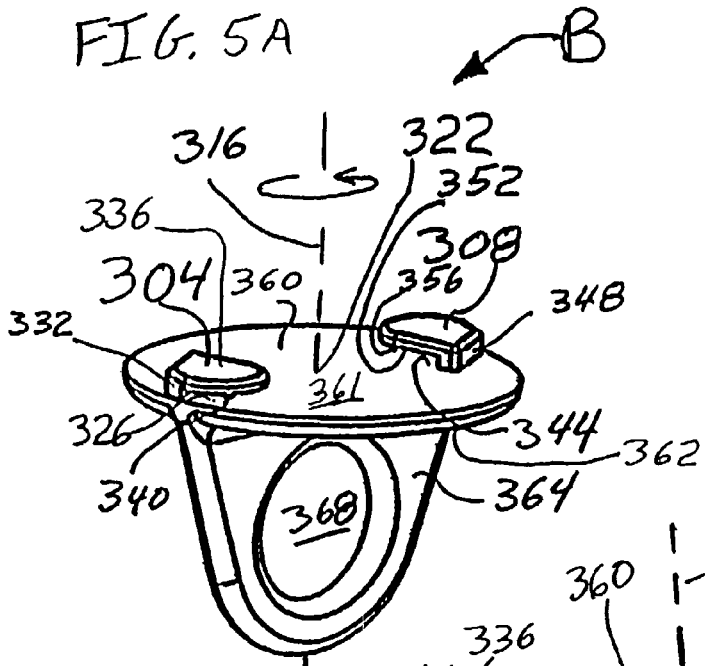
FIG. 5A is a perspective view of a second sign hanger in accord with a second preferred embodiment of the present invention.
Figure 5B:
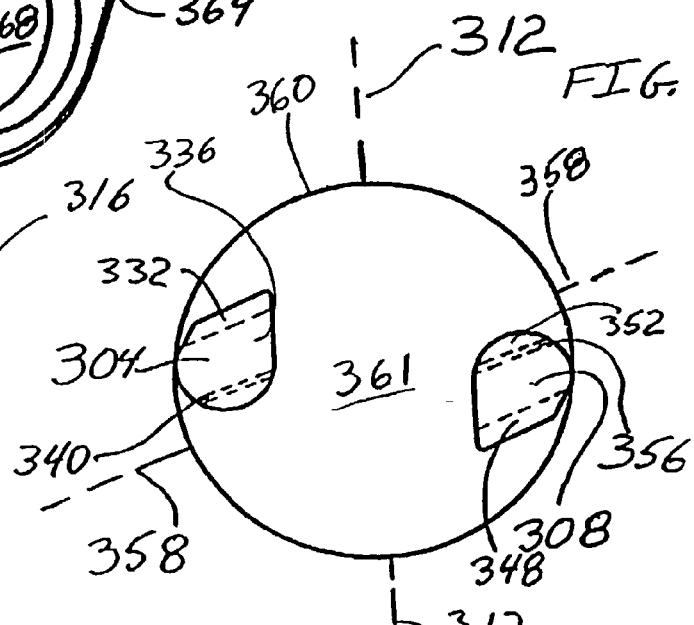
FIG. 5B is a top plan view of the sign hanger of FIG. 5A.
Figure 5C:
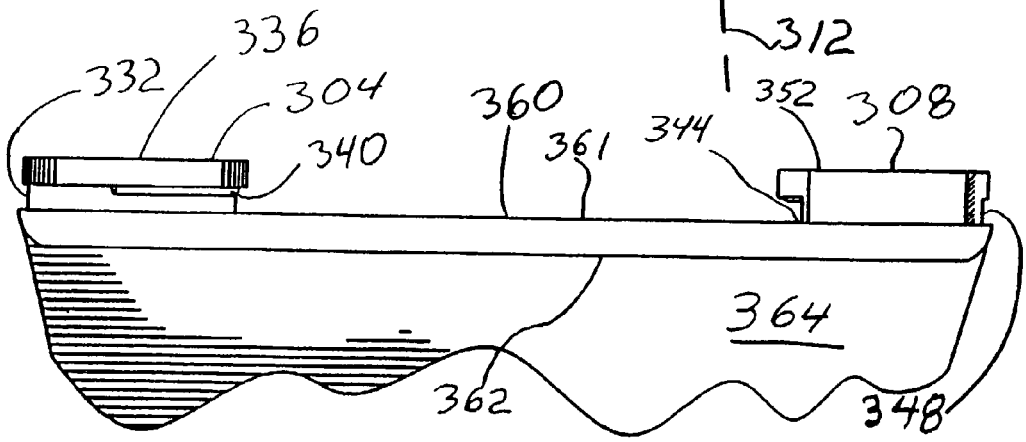
FIG. 5C is an enlarged front elevation view of the sign hanger of FIG. 5A.
Figures 6A, 6B, 6C:
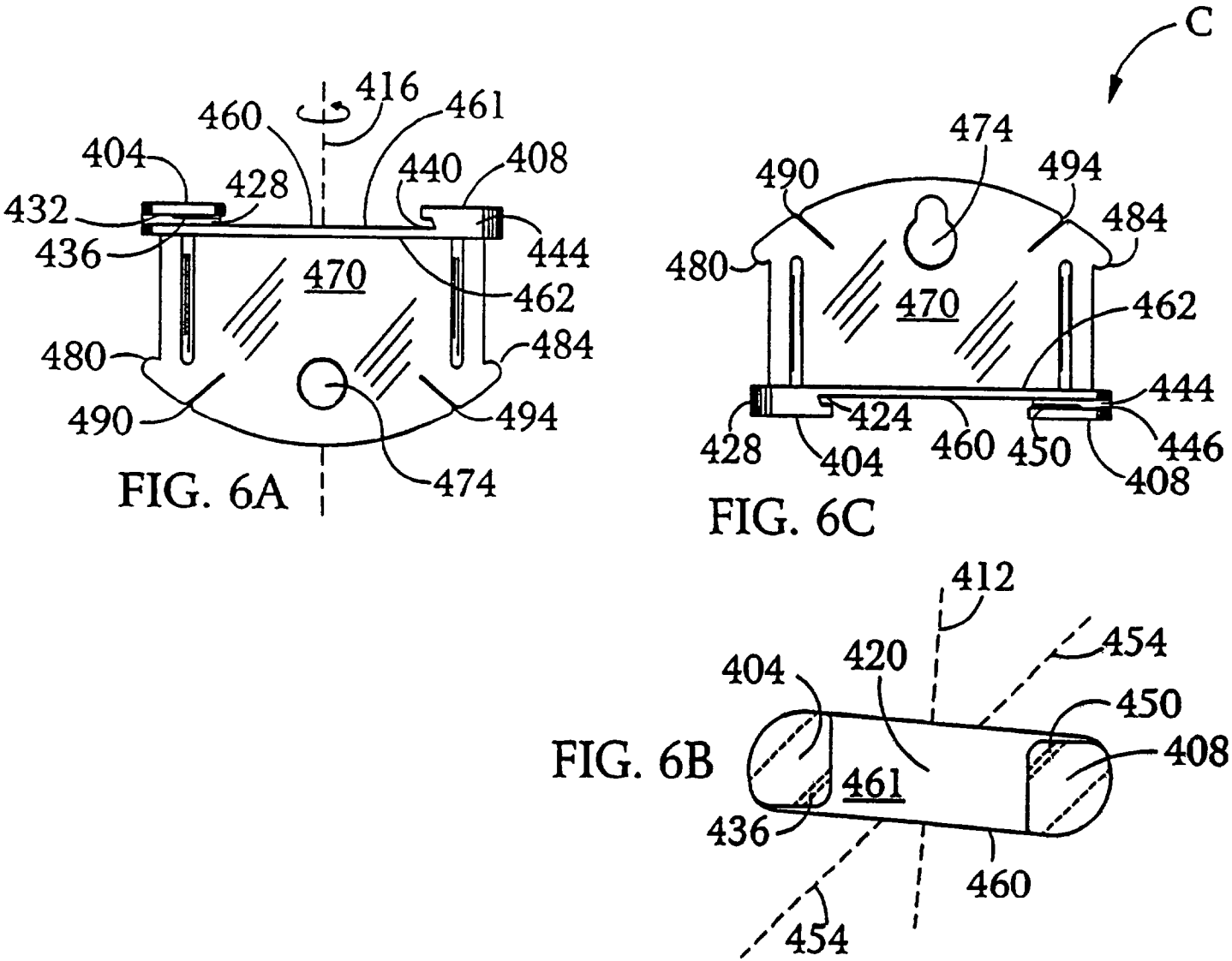
FIG. 6A is a rear elevation view of a third sign hanger in accord with a third preferred embodiment of the present invention.
FIG. 6B is a top plan view of the sign hanger of FIG. 6A.
FIG. 6C is a front elevation view of the sign hanger of FIG. 6A, with the sign hanger upside down.
Figure 7:
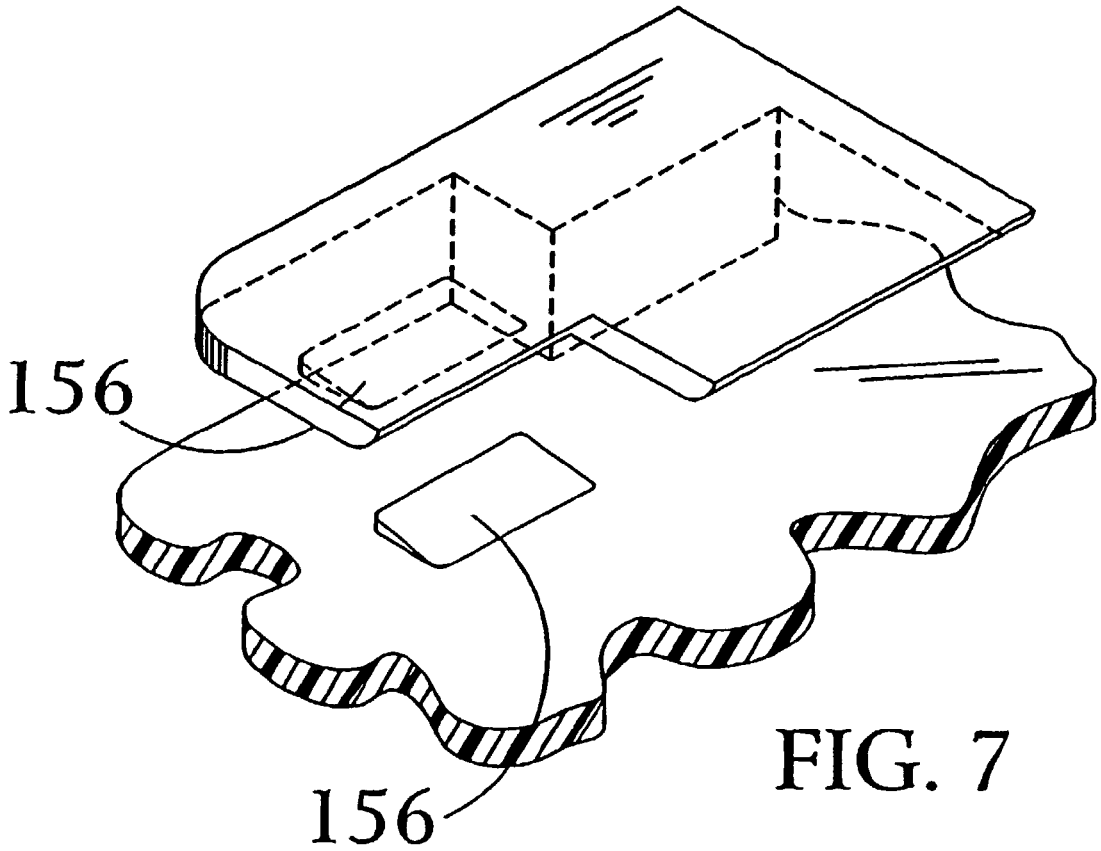
FIG. 7 is a greatly enlarged perspective view of rubber strips or pads installed on flange engaging surfaces of a clip.

Referring now to FIGS. 5A–5C, a second sign hanger or support B has first and second clips 304, 308 opposedly disposed and laterally separated from a transverse axis 312 that runs perpendicularly through an axis of rotation or pivot axis 316 at a pivot point 322. The second sign hanger B is rotated about the axis of rotation or pivot axis 316 during the installation process. The first clip 304 includes a first or base surface 326, and an arm comprising a stem 332 extending upward from the first surface 326, and a flange 336 supported in a cantilevered manner from the stem 332. A non-binding, friction-increasing device, such as, a protrusion, tapered surface or rib 340, is included on the flange 336. Similarly, the second clip 308 also includes a first surface 344, a stem 348, and a flange 352 including a non-binding, friction-increasing protrusion, tapered surface or rib 356. The flanges 336, 352 of the first and second clips 04, 308 extend toward a longitudinal axis 358 of the sign hanger B from their respective stems 332, 348. The longitudinal axis 358 is a line that runs parallel to the ceiling grid work when the second sign hanger B is in an installed position. The longitudinal axis 358 is centered between the clips 304, 308.

As described in relation to the first sign hanger A, the ribs 340, 356 are friction-increasing and operate in a manner similar to that described in reference to the first sign hanger A. Optionally, protrusions or tapered surfaces may be included instead of, or in addition to, the ribs 340, 356.

The second sign hanger B further includes a circular first support portion 360 having a first or top side 361 and a second or bottom side 362. The first support portion 360 interconnects the first surface 326 of the first clip 304 and the first surface 344 of the second clip 308. The support portion 360 can lie in a support body plane.

An object support flange 364 depends downward from the first support portion 360. The object support flange defines an object support plane. The object support plane can be substantially perpendicular to the support body plane. The flange 364 includes a means to attach an object to the second sign hanger B. The illustrated embodiment includes an eyelet or opening 368, useful for attaching a hook (not shown) or cord (not shown) or the like, but other attachment means are contemplated. For example, an anchor or a hook can be included on the flange 364. The eyelet or opening 368 shown is of a particular size, but other sizes are within the scope of the invention. Alternatively, anchors or hooks can be included on the flange.

The second sign hanger B can be installed by hand or in a manner similar to that described with reference to the first sign hanger A. Where the installation tool is used, the object to be supported is generally attached to the first object support flange after the second sign hanger is installed on a ceiling. The illustrated object support flange 364 of the second sign hanger B is of sufficient thickness to fit snugly within the socket of the installation tool. Therefore, the object support flange 364 does not include widening ribs.

Referring now to FIG. 6, a third sign hanger or support C has a first and second clip 404, 408 opposedly disposed and laterally separated from a transverse axis 412 that runs perpendicularly through an axis of rotation 416 at a pivot point 420. The third sign hanger C is rotated about the axis of rotation 416 during the installation process in a manner similar to that described in reference to the first sign hanger A. The first clip 404 includes a first or base surface 424, and an arm comprising a stem 428 extending upward from the first surface 424, and a flange 432 supported in a cantilevered manner from the stem 428. A non-binding, friction-increasing device, such as a protrusion, tapered surface or rib 436 is included on the flange 432. Similarly, the second clip 408 includes a first or base surface 440, a stem 444, and a flange 446 including a non-binding, friction-increasing protrusion, tapered surface or rib 450. The flanges 432, 446 of the first and second clips 404, 408 extend toward a longitudinal axis 454 from their respective stems 428, 444. The longitudinal axis 454 is a line that runs parallel to the ceiling grid when the third sign hanger C is in an installed position. The longitudinal axis 454 is centered between the clips 404, 408.

As described in relation to the first sign hanger A, the ribs 436, 450 are friction-increasing and operate in a manner similar to that described in reference to the first sign hanger A.

The third sign hanger C further includes a trapezoidal or rectangular first support portion 460 including a top side 461 and a bottom side 462. The first support portion interconnects the first surface 424 of the first clip 404 and the first surface 440 of the second clip 408. The first support portion defines in a support body plane.

An object support flange 470 depends downward from the first support portion 460. The first object support flange 470 includes a means to attach an object to the third sign hanger C. In the illustrated embodiment the means to attach an object to the third sign hanger C is an anchor 474 suitable for looping an end of a string (not shown) or cord (not shown) around, but other attachment means are contemplated. For example, an eyelet, opening or hook can be included on the first object support flange.

The first object support flange 470 also includes first and second projections 480, 484 for preventing a stored string (not shown), looped around the first object support flange, from slipping and sliding off the first object support flange 470. Additionally, the first object support flange 470 includes first and second slots 490, 494. The slots 490, 494 can be used to secure the end of the string (not shown) when it is in the stored configuration, thereby preventing the looped string from unraveling.

The third sign hanger C can be installed by hand or in a manner similar to that described with reference to the first sign hanger A. Where the installation tool 210 is used, the object to be supported, is generally attached to the first object support flange 470 after the third sign hanger C is installed on the ceiling grid.

Referring now to FIGS. 8A–8E, a fourth sign hanger or support D has a first and second clip 804, 808 opposedly disposed and laterally separated from a transverse axis 812 that runs perpendicularly through an axis of rotation or pivot axis 816 at a pivot point 820. The fourth sign hanger D is rotated about the axis of rotation 816 during the installation process in a manner similar to that described in reference to the first sign hanger A. The first clip 804 includes a first or base surface 824, and an arm comprising a stem 828 extending upward from the first surface 824, and a flange 832 supported in a cantilevered manner from the stem 828. A non-binding, friction-increasing device, such as a protrusion, rib or tapered surface 836 is included on a wall of the flange 832. Similarly, the second clip 808 includes a first or base surface 840, a stem 844, and a flange 846 including a non-binding, friction-increasing protrusion, rib or tapered surface 850 on a wall of the flange 846. The flanges 832, 846 of the first and second clips 804, 808 extend toward a longitudinal axis 854 from their respective stems 828, 844. The longitudinal axis 854 is a line that runs parallel to the ceiling grid when the fourth sign hanger D is in an installed position. The longitudinal axis 854 is centered between the clips 804, 408. The tapered areas 836, 850 are on the flanges 832 and 846 and the tapering extends towards the longitudinal axis 854. Preferably, the tapered areas 836, 850 of the flange walls each extend across a width of their respective arms. Extending the tapered surfaces over the width of the arm maximizes a sliding surface area as well as a retention contact surface area that the tapered surfaces can produce against an associated ceiling grid member.

The flange tapered surfaces 836, 850 are friction-increasing and operate in a manner similar to that of the ribs or protrusions described in reference to the first sign hanger A. However, instead of engaging a ceiling grid element suddenly, during an installation process, the tapered surfaces enable the flanges to gradually engage the ceiling grid member, increasing a resistance to movement as the ceiling grid member is brought into deeper engagement with clips 804, 808.

Figures 8A, 8B, 8C, 8D, 8E:
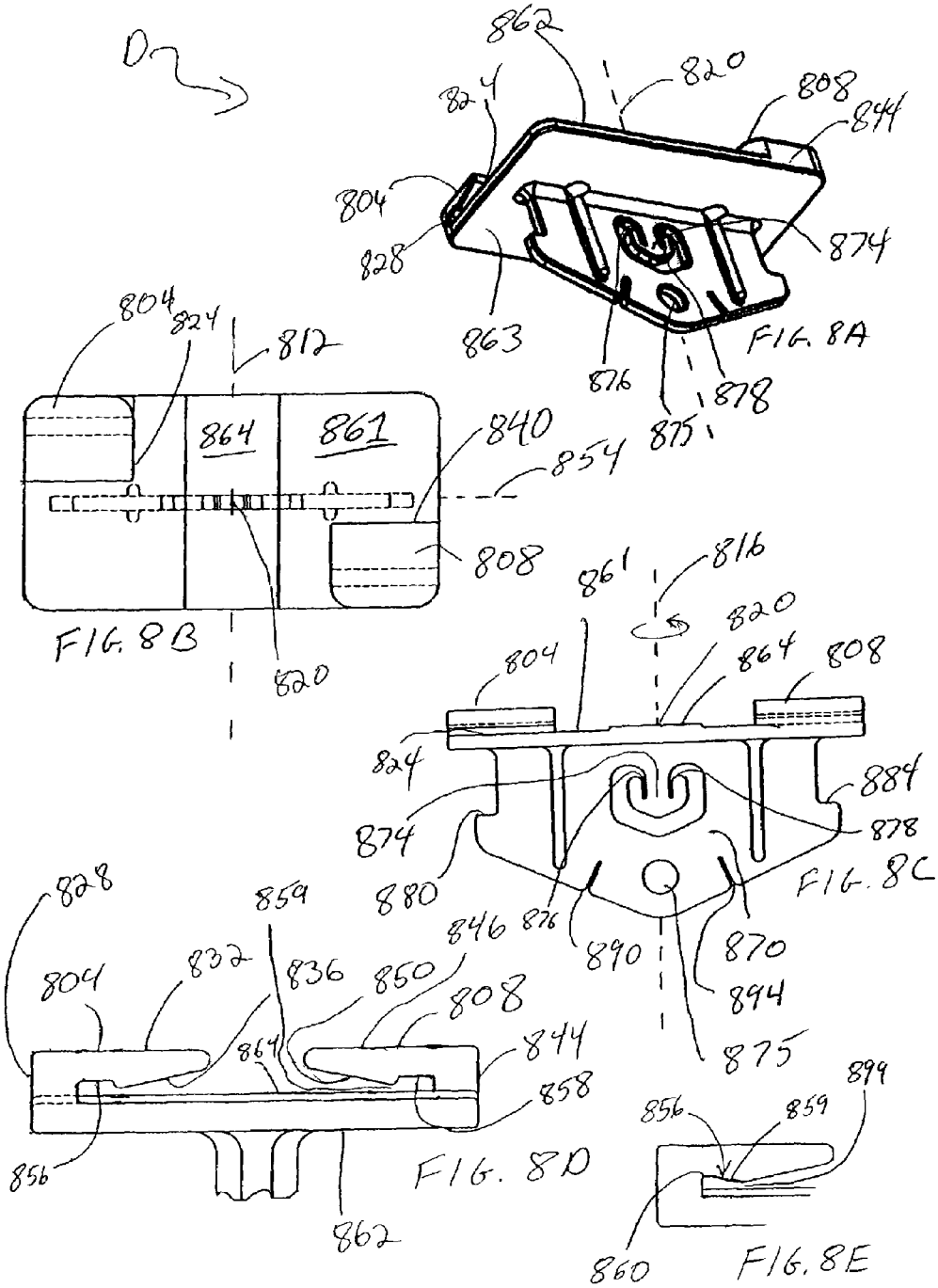
FIG. 8A is a perspective view of a fourth sign hanger in accordance with a fourth preferred embodiment of the present invention.
FIG. 8B is a top plan view of the sign hanger of FIG.8A.
FIG. 8C is a front elevation of the sign hanger of FIG.8A.
FIG. 8D is a partial side elevation of the sign hanger of FIG. 8A.
FIG. 8E is a partial side elevation of the sign hanger of FIG. 8A showing an alternate embodiment of a clip portion of the sign hanger.

Preferably, the flanges 832, 846 include relatively thin neck regions 856, 858. The neck regions are thin enough to allow the flanges 832, 846 to flex slightly as the ceiling grid element comes into engagement with the clips 804, 808. As the neck regions are flexed, an increased spring force is applied between the flanges and the ceiling grid members the flanges are engaged with. An exemplary neck thickness, for a fourth sign hanger D made of ABS is about 0.080 inches. In this neck region design, the neck region has a rectangular lower surface. As shown in FIG. 8E, the neck regions can include reverse tapered surfaces 859 having thinnest regions closer to the stems 828, 844. Such reverse tapered surfaces 859 concentrate all flexing stresses at region 860 where the flanges 832, 846 meet the stems 828, 844, thereby increasing a spring force associated with flexing the flanges 832, 846. Where an associated ceiling grind member has a bulbous or curled edge portion, as some ceiling grid members are known to include, the neck portions 856, 858 or stress regions 860 are operative to capture or partially surround the bulbous or curled portion when the object hanger is in a installed position. This capturing of the bulbous or curled portion provides an additional retention force for the object hanger.

The fourth sign hanger D further includes a trapezoidal or rectangular support portion or body 861 including a top side 862 and a bottom side 863. The support portion or body 861 interconnects the first surface 824 of the first clip 804 and the first surface 840 of the second clip 808. The support portion lies substantially in a support body plane. The first and second clips 804, 808, and therefore, the first and second protrusions, ribs or tapered surfaces 836, 850 are located adjacent opposed corners of the support body 861.

Optionally, the support portion or body 861 includes a friction increasing protrusion or plateau 864. When included, for example, on the fourth sign hanger D, the friction increasing protrusion or plateau 864 acts as a pivot area and contact surface around which clipping forces of the clips 804, 808, in engagement with a ceiling grid element, tend to bend or flex at least one of the sign hanger and the ceiling grid element. In this manner, one or both of the ceiling grid element and the sign hanger, are placed in a friction or grip increasing tension. In effect, the plateau 864 reduces a clip gap 899 associated with the first and second clips 804, 808. The reduction in the clip gap 899 leads to a tighter fit between the clips of the fourth sign hanger D and an associated ceiling member (not shown). The tighter fit leads to an increase in flange 832, 846 flexure when the clips 804,808 engage the associated ceiling member. The increase in flexure leads to an increase in clip spring force, which results in an increased gripping force applied, between the sign hanger and the ceiling member. In this regard, the first and second protrusions, ribs or tapered surfaces 836, 850 and the friction increasing protrusion or plateau 864 releasably grip opposed surfaces of the associated ceiling grid.

Alternatively, the clip gap 899 may be reduced by shortening the stems 828, 844 or by altering the dimensions of the protrusions or tapered surfaces. However, these solutions can be difficult to achieve with inexpensive molding techniques or without the use of secondary finishing operations. The plateau 864 achieves the desired gap reduction while permitting the use of inexpensive molding techniques.

Preferably, the plateau 864 extends approximately transversely to the longitudinal axis 854 across the support body 861 top side 862 from one side edge to another side edge. Extending the plateau 864 across the support body improves a stability of the sign hanger during the installation process. For example, if a centrally located plateau is used that extends only partially across the support body 861, then any misalignment that occurs before the clips are rotated into engagement with an associated ceiling member might lead to wobbling. The wobbling would make it more difficult to install the sign hanger.

The plateau 861 can be fairly wide, perhaps, on the order of being half as wide as the horizontal ceiling grid member. In one exemplary embodiment of the illustrated sign hanger D, the plateau 861 is 0.5 inches wide, 1.2 inches long and is raised 0.02 inches above the surface of the support body 860. Preferably the plateau, in its role as a contact surface, does not include voids or destabilizing surface distortions.

An object support flange 870 depends downward from the support portion or body 861. The object support flange 870 includes a means to attach an object to the fourth sign hanger D. In the illustrated embodiment the means to attach an object to the fourth sign hanger D is an anchor 874 suitable for looping an end of a string (not shown) or cord (not shown) around. However, other attachment means are contemplated. For example, an eyelet, opening 875 is also included on the object support flange 870. Alternatively or additionally, a hook or other mounting device can be included on the object support flange 870. The anchor 874 includes first and second slots 876, 878. The slots 890, 894 can be used to secure an end of the string (not shown) to the anchor. The end of the string can be secured in the first slot 876, wrapped halfway around the anchor and secured in the second slot, and wrapped another half turn around the anchor and secured again in the first slot. This process can be repeated until the friction between the slots 876, 878 and the string is sufficient to keep the string from unraveling. In this way a string can be attached to the sign hanger D without the use of knots. Knots tend to weaken a string and are difficult to untie when the string must be replaced.

The object support flange 870 also includes first and second projections 880, 884 for preventing a stored string (not shown), looped around the first object support flange, from slipping and sliding off the object support flange 870. Additionally, the object support flange 870 includes third and fourth slots 890, 894. The slots 890, 894 can be used to secure the end of the string (not shown) when it is in the stored configuration, thereby preventing the looped string from unraveling.

The fourth sign hanger D can be installed and deinstalled by hand or in a manner similar to that described with reference to the first sign hanger A. No prying tools such as a screwdriver to pair of pliers are required to remove the fourth sign hanger. Therefore, the fourth sign hanger is releasable in the sense defined above. Where the installation tool 210 is used, the object to be supported is generally attached to the object support flange 870 after the third sign hanger C is installed on the ceiling grid.

The sign, banner or object hangers described above have a reduced risk of accidental disengagement. At least one of them enables a one step attachment of a banner to a ceiling grid, rather than requiring the installation of several spaced clips for supporting the banner. They allow for the secure, temporary attachment, of signs, plants, banners and the like, to suspended or dropped ceiling support grids, without requiring the use of a ladder. They do not bind with the ceiling grid. Therefore they do not scratch and mar the ceiling grid surface. Furthermore, they can be removed without the use of screwdrivers, pliers or similar prying devices. While the object hangers can be easily removed when desired, with minimal effort, they include pads, ribs, tapered surfaces and/or plateaus that resist accidental rotation and disengagement. These pads, ribs, tapered surfaces and plateaus can embody friction-increasing means for enhancing a releasable holding power of the object hanger on a ceiling grid. Their structure resists rotation, to a limited extent, so they are relatively easy to suspend, then lock in place on a ceiling grid, while at the same time being removable and reusable.

The invention has been described in connection with preferred embodiments of sign hangers. However, alterations and modifications will occur to those of average skill in the art upon reading and understanding of this specification. It is intended to include all such modifications and alterations which come within the scope of the appended claims or the equivalents thereof.

Having thus described the preferred embodiments, the invention is now claimed to be:

1. A ceiling grid banner hanger comprising:

an elongated support body having a top side, an opposed bottom side and a longitudinal axis;

a first stem extending away from said top side;

a first flange supported in a cantilevered manner from the first stem;

a second stem extending away from said top side;

a second flange supported in a cantilevered manner from the second stem, wherein said first stem is located on a first side of said longitudinal axis and said second stem is located on a second side of said longitudinal axis;

a first protrusion depending from said first flange and extending toward said top side;

a second protrusion depending from said second flange and extending toward said top side, wherein said first and second flange have a length defined by a maximum distance between two side edges of said first and second flange respectively and wherein said first and second protrusions each extend along all of said length of their respective flange to releasably engage an associated ceiling grid surface to resist disengagement of said elongated support body from the associated ceiling grid; a first object support flange extending away from said bottom side; and, a second object support flange extending downwardly away from said bottom side, said first and second object support flanges lying substantially in a single object support plane.

2. The banner hanger of claim 1 wherein said object support plane is aligned with said longitudinal axis.

3. The ceiling grid banner hanger of claim 1 wherein said first and second arms each further comprise a first region for engaging the associated ceiling grid early in an installation process, and a second region for engaging the associated ceiling grid later in the installation process and wherein said first protrusion is located on said second region of said first arm, and said second protrusion is located on said second region of said second arm.

4. The ceiling grid banner hanger of claim 1 further comprising at least one attachment means located on said first object support flange for supporting an object.

5. The ceiling grid banner hanger of claim 1 wherein said first object support flange extends along said longitudinal axis.

6. The ceiling grid banner hanger of claim 1 wherein said first object support flange comprises at least one projection extending laterally from a body of said first object support flange.

7. The ceiling grid banner hanger of claim 1 further comprising a third protrusion, the third protrusion located on the support body, whereby the third protrusion cooperates with at least one of the first and second protrusions to increase the resistance to disengagement from said ceiling grid of said ceiling grid banner hanger by engaging a surface of the ceiling grid opposite a surface of the ceiling grid engaged by at least one of the first and second protrusions.

8. In combination, a ceiling grid banner hanger operative to suspend a sign from a ceiling grid, comprising:

a ceiling grid including opposed planar surfaces; and a hanger comprising a support body having a top side, an opposed bottom side and a longitudinal axis;

a first arm extending away from said top side;

a first protrusion extending from said first arm toward said top side;

a second arm extending away from said top side;

a second protrusion extending from said second arm toward said top side;

a third protrusion extending upwardly from said top side, wherein said first, second and third protrusions engage said planar surfaces of said ceiling grid to resist disengagement of said support body from said ceiling grid and wherein said first, second and third protrusions releasably grip said opposed surfaces of said ceiling grid to which the support body is selectively secured so that said support body can be manually removed without a need for tools to dislodge said first second and third protrusions from contact with said ceiling grid; and, a first object support flange extending away from said support body bottom side.

9. The banner hanger of claim 8 wherein said third protrusion extends across said support body top side from one side edge of said support body to another side edge thereof.

10. The banner hanger of claim 9 wherein said third protrusion is oriented approximately transverse to said support body longitudinal axis.

11. The banner hanger of claim 8 wherein said third protrusion is centrally located between said first and second arms.

12. The hanger of claim 8 wherein said support body is substantially rectangular and said first and second protrusions are located adjacent opposed corners of said support body.

13. A one-piece ceiling grid object hanger comprising:

a support body defining a support body plane and having a longitudinal axis and a rotational axis;

a first arm, including a first stem and a first cantilevered flange, the first stem extending away from the support body;

a second arm, including a second stem and a second cantilevered flange, the second stem extending away from the support body, wherein the first arm is located on a first side of the longitudinal axis and the second arm is located on a second side of the longitudinal axis;

a first tapered wall depending from the first flange, the first tapered wall tapering towards the longitudinal axis;

a second tapered wall depending from the second flange, the second tapered wall tapering towards the longitudinal axis, wherein the first and second tapered walls and the support body co-operate to engage an associated ceiling grid member with a progressively firmer grip as the object hanger is rotated from a disengaged position relative the associated ceiling grid into an engaged position, wherein said first and second tapered walls each extend across a width of their respective arms;

wherein the first and second flanges, carrying the first and second tapered walls, are connected to first and second stems by first and second neck regions respectively; and, wherein the first and second neck regions include reverse tapered sections relative to the first and second tapered walls; and, a first planar object support flange depending from the support body, the first planar object support lying substantially in a first object support plane, the object support plane being perpendicular to the support body plane and intersecting a rotational axis of the support body.

14. The object hanger of claim 13 further comprising:

a plateau, located on the support body between the first and second arms, the plateau serving as a pivot area around which the support body is rotated to place the first and second arms into a grip enhancing tension with the associated ceiling grid member when the first and second arms are in engagement with the associated ceiling grid member.

15. The object hanger of claim 13 further comprising:

a friction increasing plateau located on the support body, between the first and second arms.

16. The object hanger of claim 15 wherein the friction increasing plateau extends transversely across the support body top side from one side edge to another side edge.

17. A ceiling grid banner hanger operative to suspend a sign from an associated ceiling grid, the hanger comprising:

a support body having a top side, an opposed bottom side and a longitudinal axis;

a first arm extending away from said top side;

a first rib extending from said first arm toward said top side;

a second arm extending away from said top side;

a second rib extending from said second arm toward said top side;

a protrusion extending upwardly from said top side, wherein said first, second ribs and the protrusion engage opposed planar surfaces of an associated ceiling grid to resist disengagement of said support body from said associated ceiling grid and wherein said first, second ribs and protrusion releasably grip said opposed surfaces of the associated ceiling grid to which the support body is selectively secured so that said support body can be manually removed without a need for tools to dislodge said first and second ribs and the protrusion from contact with the associated ceiling grid; and, a first object support flange extending away from said support body bottom side.

18. The ceiling grid banner hanger of claim 17 wherein a longitudinal axis of the first rib and a longitudinal axis of the second rib extend in a direction parallel to said longitudinal axis of said support body.

* * * * *